United States Patent [19]

Silver

[11] 4,189,049

[45] Feb. 19, 1980

[54] UNITARY HANGER DISPLAY PACKAGE

[75] Inventor: Edward S. Silver, High Point, N.C.

[73] Assignee: Silver Knit Industries, Inc., High Point, N.C.

[21] Appl. No.: 940,459

[22] Filed: Sep. 7, 1978

[51] Int. Cl.[2] ..... B65D 85/18

[52] U.S. Cl. ..... 206/216; 206/281; 206/493; 206/526; 206/806

[58] Field of Search ..... 206/278, 281, 294, 216, 206/459, 526, 493, 806; 229/62; 24/150 FP

[56] References Cited

U.S. PATENT DOCUMENTS

| | | | |
|---|---|---|---|
| 478751 | 7/1892 | Howard | 206/281 |
| 558,291 | 4/1896 | Lynham | 206/526 |
| 2,995,845 | 8/1961 | Fraser | 206/278 |
| 3,037,621 | 6/1962 | Jackman | 206/294 |
| 3,395,792 | 8/1968 | Larson | 229/62 |
| 3,414,175 | 12/1968 | Brosk | 206/216 |
| 3,444,597 | 5/1969 | Bone | 24/150 FP |

*Primary Examiner*—William T. Dixson, Jr.

[57] ABSTRACT

A unitary hanger display package for an article to be displayed having a hook to support the package including an article to be displayed associated with an identification label having suitable indicia thereon assembled together by a unitary securing means through the hook, article and identification label.

6 Claims, 3 Drawing Figures

UNITARY HANGER DISPLAY PACKAGE

BACKGROUND AND OBJECTIVES OF THE INVENTION

It is conventional to display socks on counters and in racks for customers to examine. Socks particularly are paired and usually are retained together with riders or wrappers or other retaining members which may include a clamping hook to suspend the socks vertically on a display rack. It is not only costly but time consuming to apply riders, labels and wrappers as well as to add further identification and price tags for each pair of socks as well as other articles that require identification and labelling.

Another problem that occurs frequently in the counter displaying of socks is that they become separated and require matching and reassembling if mating socks can be relocated.

It is also customary to encounter price tags being placed upon various articles and secured by a plastic member dispensed by an apparatus sold by Dennison and known as SWIFTATCHMENT as disclosed in U.S. Pat. 3,103,666 in which a plastic member is dispensed through a guide needle that will penetrate fabric and other materials for securing labels and tags as well as to retain articles of various types together.

The present invention related to a unitary hanger display package, preferably for displaying socks, in which the socks are secured together by a securing member which also affixes a label containing appropriate identification indicia including yarn content, size, manufacturer's name, and trademark markings with a minimum of labor and cost.

A further objective of this invention is to provide a unitary hanger display package with means for suspending the package with relatively inexpensive materials that are inseparable normally and may be assembled together as a unit for display and sale as a compact attractive package.

Other advantages and objectives will become more readily apparent from a more detailed description of the invention taken in conjunction with the drawing and claims which are not intended to be limited to the specific embodiment described or claimed.

DETAILED DESCRIPTION OF INVENTION

Figure 1:
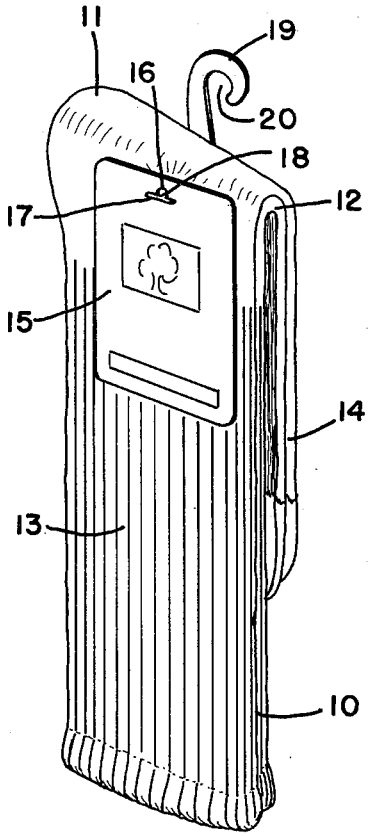
FIG. 1 is a perspective view of a unitary hanger display package of socks illustrating one side of the package with the identification label secured.
Figure 2:
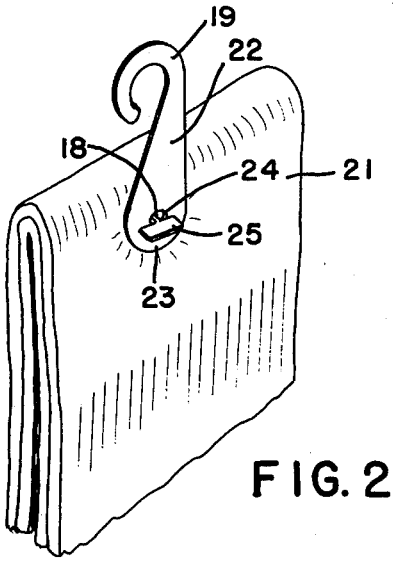
FIG. 2 is a partial perspective view of the opposite side of FIG. 1 illustrating the package with a supporting hanger retained on the securing member that penetrates the socks and identification label shown in FIG. 1.

Referring to the drawing and particularly to FIG. 1, there is illustrated a pair of socks 10 folded over in the heel 11 and instep 12 so that the leg portion 13 appears on one side and the foot portion 14 appears on the other side of the package. It will be readily apparent that the nature of the article to be displayed may vary and the sock package illustrated is but one example.

A label 15 is supported on one face of the package and contains the requisite identification indicia including trademark, manufacturer's name, fiber content, size, and price, among other information. The identification label 15 is provided with an opening 16 through which a T-shaped plastic member 17 projects transversely from the linear penetrating stem 18 which extends through the socks.

An upwardly extending hook-like plastic member 19 provided with an opening 20 is positioned on the opposite side 21 of the sock package with the hook-like member 19 being substantially flat and the base 22 of which extends downwardly to the curved base 23. An opening 24 is provided in the hook-like member 19 through which the linear filament 18 extends that is securely fastened to the substantially rectangular protuberance 25.

Figure 3:
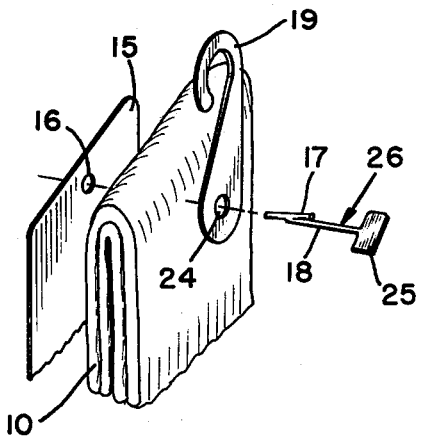
FIG. 3 is a partial, perspective and exploded view illustrating the various components prior to assembling the unitary display package.

It would be readily apparent that the penetrating or securing member 26 as shown in FIG. 3 is integrally formed and is of conventional construction and produced by Dennison Manufacturing Company for use with its SWIFTACHMENT in accordance with U.S. Pat. No. 3,103,666 in which a series of such elements are mounted on a bar and dispensed through a needle by bending the T-shaped section 17 substantially in alignment with the linear section 18 enabling the penetrating needle to guide the securing and penetrating element 26 through the opening 24 in the hook-like member 19 and through the various plies of knitted fabric in the sock package 10 before entering and penetrating through the opening 16 in the label 15. Upon withdrawal of the penetrating needle, the T-shaped end member 17 will assume the position shown in FIGS. 1 and 3 to retain the label in position along with the other components forming the package as an integral package unit.

The assembled package as shown in FIG. 1 may be placed upon a suitable peg display panel for support on a peg by the hook-like member 19.

Should the identification label 15 be torn or removed from the sock package, the socks will continue to remain together as a pair without requiring re-mating.

It will be readily apparent that assembly of the various components including the hook, the pair of socks, and the identification label will require alignment suitably to receive the securing member 26 which may be readily achieved by appropriate fixtures and the use of the Dennison SWIFTACHMENT.

The identification label may be pre-printed with the requisite information thereon including price information or price information tags may be adhered to the labels by the ultimate retailer.

By utilization of the unitary hanger display package, it is contemplated the substantial expense in packaging may be eliminated and other problems overcome that are attendant to the present manner of packaging and displaying hosiery, socks and other articles on display racks or on counters.

I claim:

1. A unitary hanger display package comprising an article of textile manufacture having opposite sides such as a pair of socks to be displayed, a unitary freely moveable means for suspending said article in a vertical position positioned on one side of said article, a flat unfolded identification label having indicia thereon, positioned on the opposite side of said article, and a thermoplastic filament means penetrating said suspending means, said article and said label and retaining them together as a unit to form an integral package.

2. A unitary hanger display package as claimed in claim 1, said suspending means having an end hook and an opening opposite therefrom.

3. A unitary hanger display package as claimed in claim 1, said article being a pair of socks.

4. A unitary hanger display package as claimed in claim 1, said identification label having an opening therein cooperatively to receive said penetrating means therethrough.

5. A unitary hanger display package as claimed in claim 1, said penetrating means having a linear plastic filament and end protuberances to retain said suspending means and said label at opposite sides of said article.

6. A unitary hanger display package as claimed in claim 1, said suspending means including a flat plastic hook member having an opening at one end to be retained on a supporting fixture and a penetrating means opening at the other end, said article being a pair of socks with said hook member positioned against said socks at one side thereof, said securing means penetrating said hook opening and pair of socks and identification label, said label being positioned on said socks opposite from said hook member, said penetrating means including a plastic linear filament having end protuberances at opposite ends to engage at one end with said identification label and with said hook member at the other end.

* * * * *